United States Patent [19]

Jamin

[11] 4,054,331

[45] Oct. 18, 1977

[54] SEALING MEANS

[75] Inventor: Guillaume Ward Jamin, Manchester, England

[73] Assignee: Imperial Chemical Industries Limited, London, England

[21] Appl. No.: 627,773

[22] Filed: Oct. 28, 1975

[30] Foreign Application Priority Data

| | | |
|---|---|---|
| Nov. 4, 1974 | United Kingdom | 47605/74 |
| May 1, 1975 | United Kingdom | 18206/75 |

[51] Int. Cl.[2] ..... F16C 33/74

[52] U.S. Cl. ..... 308/3.5; 34/92; 68/5 E; 226/97

[58] Field of Search ..... 308/3.5, 187; 226/97, 226/181; 34/92, 242; 68/5 E

[56] References Cited

U.S. PATENT DOCUMENTS

| | | | |
|---|---|---|---|
| 2,918,069 | 12/1959 | Brown et al. | 226/186 X |
| 3,245,334 | 4/1966 | Long | 226/97 X |
| 3,281,957 | 11/1966 | Ranney et al. | 226/97 X |
| 3,593,901 | 7/1971 | Eltz et al. | 226/181 |

*Primary Examiner*—Richard A. Bertsch

*Attorney, Agent, or Firm*—Cushman, Darby & Cushman

[57] ABSTRACT

A sealing apparatus which enables web material to be passed through a gap in a wall includes a plurality of main rollers in the gap in sequential contact between which the web material passes, an auxiliary roller in contact with the first and last main rollers, and a pressure-loaded bearing block mounted in a housing which forms part of the walls surrounding the gap, the coefficient of expansion of the bearing block being greater than the coefficient of expansion of the housing, and means for heating the bearing block.

10 Claims, 3 Drawing Figures

SEALING MEANS

This invention relates to a sealing apparatus and particularly to a sealing means to prevent the passage of air between the lateral face of a cylindrical roller forming part of a sealing apparatus and the longitudinal edge of a gap in a wall which houses the cylindrical roller.

In U.S. application Ser. No. 475,913, now U.S. Pat. No. 3,920,287 there is described and claimed a sealing apparatus for permitting continuous passage of a web material through a gap in a wall separating two zones at different pressures while minimizing the flow of air from one zone to the other, comprising:

a. first and second bearing members between which the web material passes, said bearing members being built into the gap, the first bearing member comprising a cylindrical roller rotatable about a longitudinal axle and the second bearing member comprising a cylindrical roller rotatable about a longitudinal axle which is parallel to the axle of the first bearing member and which roller comprises a solid cylindrical core the lateral face of which is covered by a layer of compressible material, the distance between the two longitudinal axles being such that the two cylindrical rollers are maintained in contact, b. first sealing means provided between the lateral faces of both bearing members and edges of the gap adjacent thereto, and c. second sealing means provided between the end faces of both bearing members and edges of the gap adjacent thereto, said second sealing means comprising a plate disposed on each side of said bearing members between the end faces of said bearing members and the gap edges adjacent thereto, and a plurality of springs for biasing each plate into contact with the corresponding end faces of said bearing members throughout the length of the said end faces.

In one embodiment of the sealing apparatus described in U.S. Pat. No. 3,920,287 the first sealing means comprises an auxiliary roller with a solid face, which bears on the lateral face of the bearing member and also on a spring loaded plate which is attached to the wall forming the long edge of the gap. However this arrangement suffers from the disadvantage that, in order to allow resilient movement of the plate, the ends thereof cannot be sealed to the end walls of the gap and hence some leakage of air occurs at these points. The present invention is designed to overcome this disadvantage.

According to the present invention there is provided an improved sealing apparatus of the type described and claimed in U.S. Pat. No. 3,920,287 wherein the improvement resides in the first sealing means which comprises two cylindrical auxiliary rollers of rigid material mounted axially parallel to the bearing members, one auxiliary roller being maintained in urgent contact with the lateral face of each of both bearing members, and two pressure loaded bearing blocks one bearing upon the lateral face of each of both auxiliary rollers and mounted in housings integral with the wall surrounding the gap, characterized in that the material comprising the bearing blocks has a coefficient of expansion greater than that of the material comprising the housings, and means are provided for heating the bearing blocks.

Each bearing block is preferably constructed of a material such as brass, bronze and ferobestos or a thermoplastic material such as nylon which preferably contains graphite. The means for heating the bearing block can be a heating coil through which a hot liquid or gas can be passed or an electrical heating element which can be embedded in the bearing block or laid in channels at the back of the block. The temperature to which the bearing block is heated when the sealing apparatus is in use, as hereinafter described, is that necessary to ensure that the bearing block expands sufficiently so that it firmly contacts the sides and end walls of the housing, thus preventing a flow of air from one side of the housing to the other.

The pressure loading of the bearing block can be effected by means of a pressurized bellows or by the use of springs which are preferably fitted with adjusting means, such as screw mountings, so that as the bearing block wears it can still be maintained in contact with the auxiliary roller by adjustment of the screws.

The housing which carries the bearing block is preferably constructed of the same material, preferably steel, as the remainder of the walls surrounding the gap in which the sealing apparatus is inserted.

The sealing apparatus of the present invention is not restricted to the particular second sealing means described and claimed in U.S. Pat. No. 3,920,287. Any suitable second sealing means which seals the end faces of the bearing members and adjacent edges of the gap may be used.

It will be appreciated that by using an auxiliary roller as part of the first sealing means the continuous passage of web material between the auxiliary roller and contiguous bearing member is possible, which passage may be concurrent with but in a direction opposite to the passage of web material between the bearing members.

It will also be appreciated that whereas the sealing means of the invention is of particular value when used as part of the sealing apparatus of U.S. Pat. No. 3,920,287 which comprises two bearing members, it may also be of value when used as part of a seal comprising three or more bearing members between which two or more lengths of web material may be conveyed concurrently, alternate lengths of material passing between the bearing members in opposite direction.

Thus according to a further embodiment of the invention there is provided a sealing apparatus for permitting continuous passage of web material in opposite directions concurrently through a gap in a wall separating two zones at different pressures while minimising the flow of air from one zone to the other, comprising, a. three or more bearing members between which web material passes, said bearing members being built into the gap, each bearing member comprises a cylindrical roller rotatable about a longiudinal axle which is parallel to the axles of the other bearing members and at least the first and last rollers and every alternate roller comprising a solid cylindrical core the lateral face of which is covered by a layer of compressible material, the distance between the longitudinal axles of adjacent rollers being such that the rollers are maintained in sequential contact;

b. first sealing means provided between the lateral faces of the first and last bearing members and edges of the gap adjacent thereto, said first sealing means comprising two cylindrical auxiliary rollers of rigid material mounted axially parallel to the bearing members, one auxiliary roller being maintained in urgent contact with the lateral face of each of the first and last bearing members, and two pressure loaded bearing blocks, one bearing upon the lateral face of each of the auxiliary rollers and mounted in housings integral with the wall surrounding the gap, characterized in that the material comprising the bearing blocks has a coefficient of expansion greater than that of the material comprising the housings, and means for heating the bearing blocks;

c. second sealing means provided between the end faces of the auxiliary rollers and bearing members and edges of the gap adjacent thereto.

The following description relates to the accompanying drawings showing by way of example only a preferred embodiment of the invention.

Figure 1:
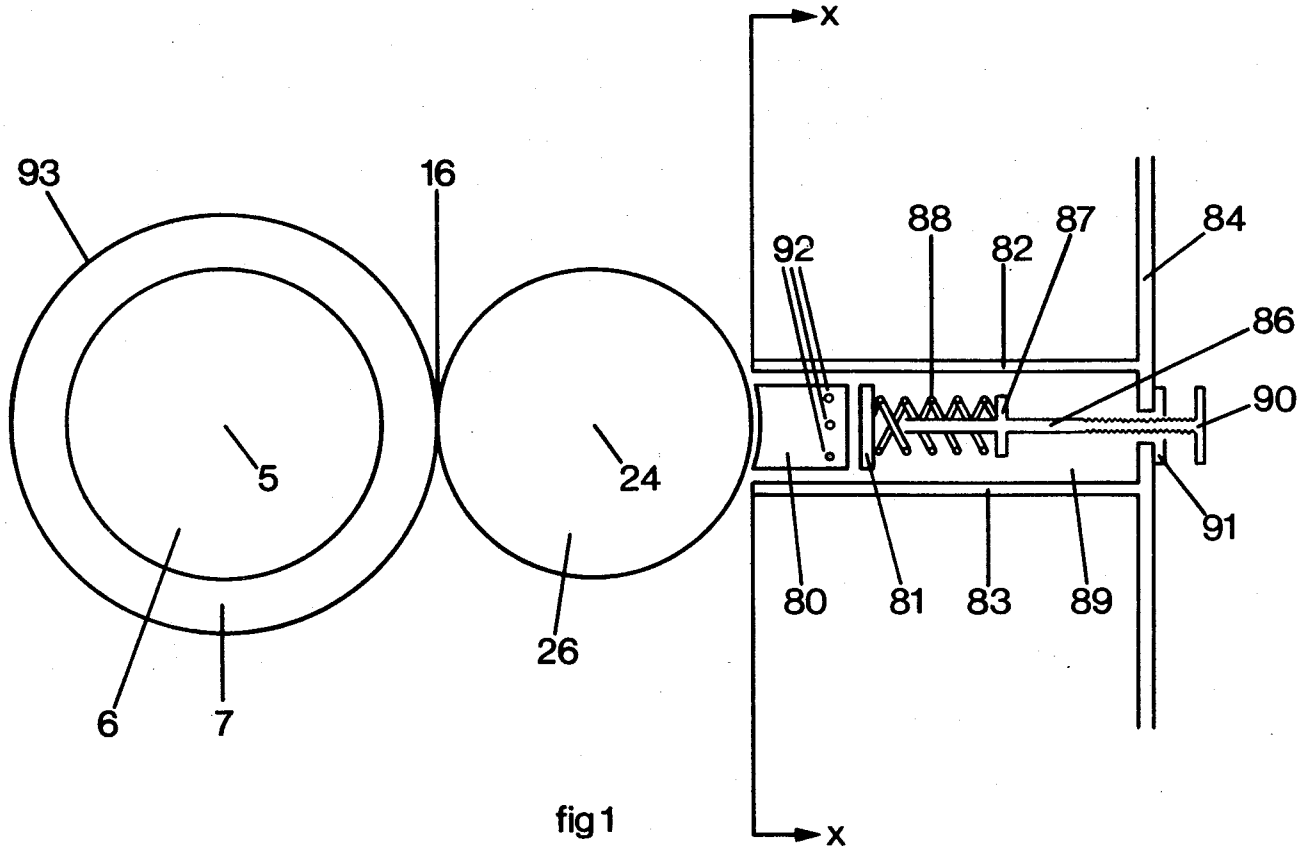
FIG. 1, is a cross-sectional representation of one of two identical parts of the first sealing means shown in relation to one bearing member and the adjacent edge of a gap in a wall.
Figure 2:
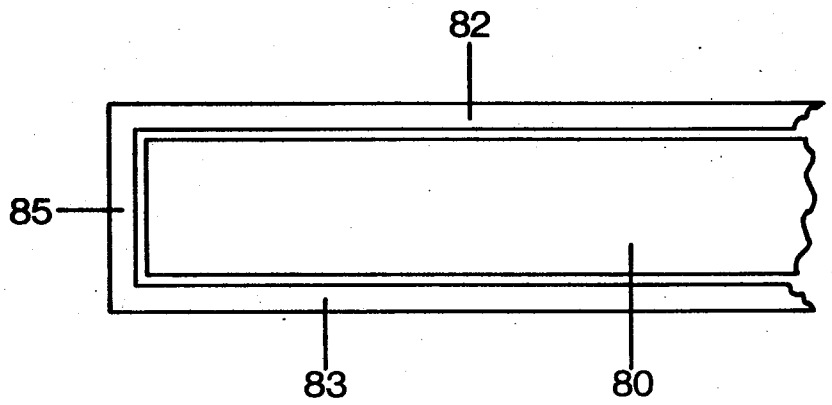
FIG. 2, is a plan view of one of the bearing blocks in its housing in the direction X—X of FIG. 1.

In the drawings, one of two identical parts of a first sealing means comprises a rigid auxiliary roller 26, rotatable about its axis 24, and a bearing block 80 having an arcuate face opposing the auxiliary roller 26 and heating elements 92 connected to a source of power (not shown). The bearing block 80 is mounted in a housing 89 defined by parallel walls 82 and 83 and end walls 85 (one only shown in FIG. 2) integral with wall 84. A coil spring 80 urges a backing plate 81 against the bearing block 80 whose arcuate face engages the auxiliary roller 26. A screw 86 threaded through the wall 84 has a handle 90, collar 87 and lock-nut 91 and provides means for adjusting the load of the coil spring 88. The auxiliary roller 26 is in urgent contact with a bearing member 93 rotatable about its axis 5 and comprising a solid cylindrical core 6 covered by a layer 7 of compressible material. The respective axes 5 and 24 of the bearing member 93 and auxiliary roller 24 are fixed and parallel.

Since the length of the bearing block 80 corresponds substantially to the length of the auxiliary roller 26 and can in fact be any length up to about 5 meters, or even longer, in order that uniform contact of the bearing block with the auxiliary roller is obtained throughout the full length it is usually necessary to have a series of springs 88 each being mounted on a similar type screw 86 and associated parts.

In use the screw or screws 86 are adjusted so that uniform contact of the bearing block 80 with the auxiliary roller 26 is obtained whilst the bearing block 80 is at ambient temperature. The heating elements 92 are then switched on which causes the bearing block 80 to expand until it bears against the walls 82, 83 and 85 thus preventing leakage of air between the bearing block and the said walls.

The first sealing means of the invention may be used as part of the sealing apparatus described in U.S. Pat. No. 3,920,287 which comprises two bearing members, or alternatively as part of a seal of the type illustrated in FIG. 3 which comprises more than two bearing members.

Figure 3:
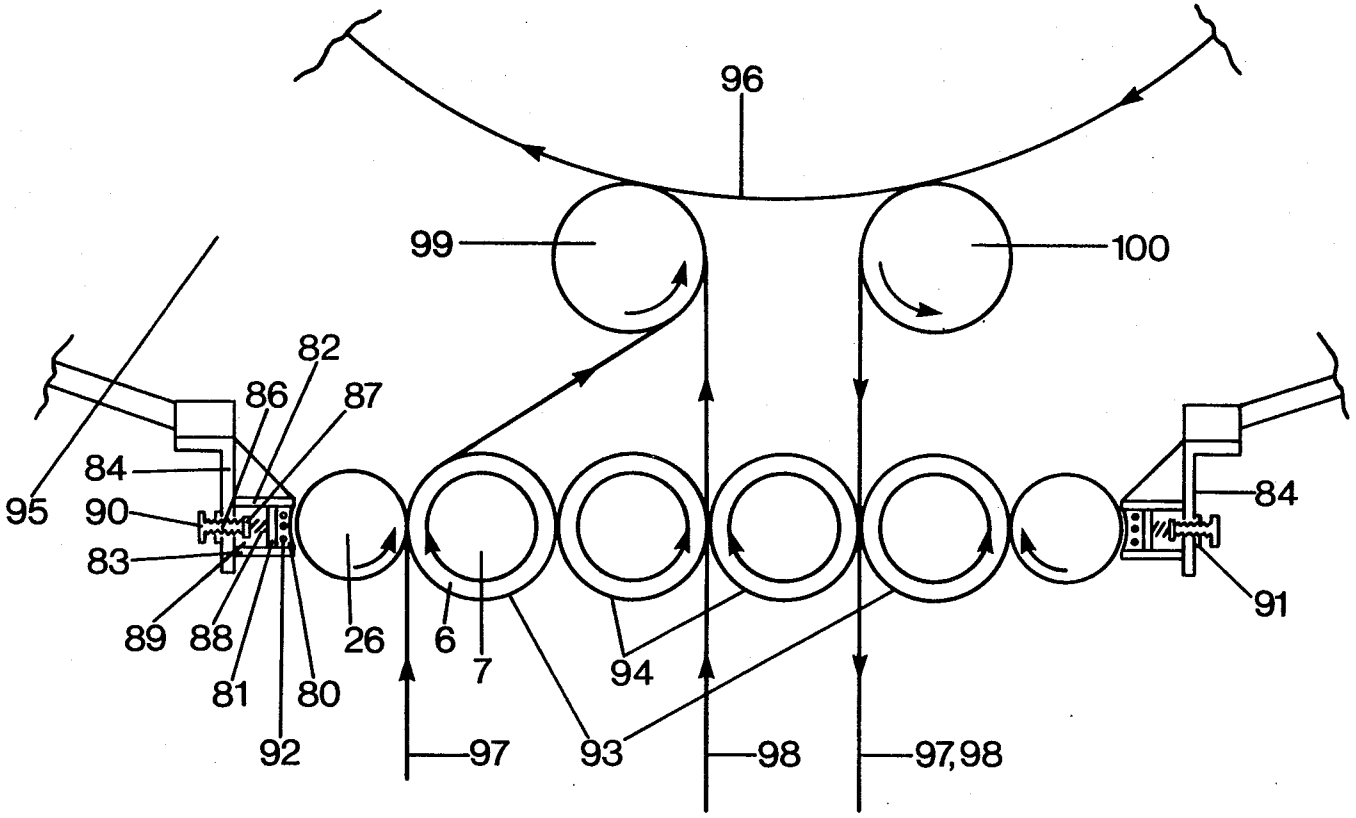
FIG. 3, is a cross-sectional representation of a sealing apparatus having a plurality of bearing members and incorporating the sealing means of the invention.

In FIG. 3, a sealing apparatus comprises two pairs of similar bearing members 93 and 94, in sequential contact, and first sealing means, as hereinbefore described, sealing the spaces between the entrance walls 84 of a chamber 95 and the outer bearing members 93. The sealing apparatus controls the entrance to the chamber 95 which houses a heated drum 96. A continuous paper sheet 97 passes between one of the auxiliary rollers 26 and contiguous first bearing member 93 and mates with a continuous sheet of textile material 98, which passes between the second and third bearing members 94, on a roller 99. The two sheets 97 and 98 in mutual contact thereafter pass round the drum 96 and are directed out of the same seal over the roller 100. The circumferential portion of the drum 96 immediately anterior to the roller 100 and the roller 100 itself are cooled to avoid smudging of the transferred print which would otherwise occur during the sudden change of direction of the sheets 97 and 98 round the roller 100 should they remain at printing temperature. Alternatively, the paper sheet 97 may be removed from the drum separately from the textile material 98 through a seal having an additional bearing member.

The operation of the sealing means has already been described and the operation of the bearing members is self-evident. The auxiliary rollers and bearing members form between them a series of nips and when in motion sheets of web material may be conveyed into and out of the evacuated or pressurized chamber through the nips in opposite directions.

The second sealing means for sealing the space between the end faces of the auxiliary rollers and bearing members and adjacent edges of the gap are not particularized herein but suitable means are described, for example, in U.S. Pat. No. 3,920,287.

The construction of the bearing members is also described in U.S. Pat. No. 3,920,287. While the bearing member has a solid cylindrical core 6, it is sufficient that the core be rigid, and the core can be constructed of a rod of metal or a tube of metal provided that the walls of the tube are of sufficient thickness to provide the necessary rigidity and capable of withstanding the effects of the desired pressure differential across the seal. The perhipheral layer of compressible material may be a flexible polyurethane or other elastomeric material.

It will be understood that details of the sealing apparatus which has been described may be varied without departing from the essential characteristics of the invention nor have details been given of the necessary ancillary equipment such as the means for setting in motion the bearing member and the auxiliary rollers.

I claim:

1. Sealing apparatus for permitting continuous passage of a web material through a gap in a wall separating two zones at different pressures while minimizing the flow of air from one zone to the other, comprising:

a. first and second bearing members between which the web material passes, said bearing members being built into the gap, the first bearing member comprising a cylindrical roller rotatable about a longitudinal axle and the second bearing member comprising a cylindrical roller rotatable about a longitudinal axle which is parallel to the axle of the first bearing member and which roller comprises a solid cylindrical core the lateral face of which is covered by a layer of compressible material, the distance between the two longitudinal axles being such that the two cylindrical rollers are maintained in contact, b. first sealing means provided between the lateral faces of both bearing members and edges of the gap adjacent thereto, said first sealing means comprising two cylindrical auxiliary rollers of rigid material mounted axially parallel to the bearing members, one of said auxiliary rollers being maintained in urgent contact with the lateral face of each of both bearing members, and two pressure loaded bearing blocks one bearing upon the lateral face of each of both of the auxiliary rollers and mounted in housings integral with the wall surrounding the gap, characterized in that the material comprising the bearing blocks has a coefficient of expansion greater than that of the material comprising the housings, and means for heating the bearing blocks;

c. second sealing means provided between the end faces of both bearing members and edges of the gap adjacent thereto.

2. Apparatus as recited in claim 1 wherein said material comprising the bearing blocks is selected from the group consisting of Ferobestos.

3. Apparatus as recited in claim 1 wherein said material comprising the bearing blocks is a thermoplastic material.

4. Apparatus as recited in claim 3 wherein said thermoplastic material is nylon.

5. Apparatus as recited in claim 3 wherein said material comprising the housings is steel.

6. Sealing apparatus for permitting continuous passage of web material in opposite directions concurrently through a gap in a wall separating two zones at different pressures while minimizing the flow of air from one zone to the other, comprising a. at least three bearing members between which web material passes, said bearing members being built into the gap, each bearing member comprising a cylindrical roller rotatable about a longitudinal axle which is parallel to the axles of the other bearing members and at least the first and last rollers and every alternate roller comprising a solid cylindrical core the lateral face of which is covered by a layer of compressible material, the distance between the longitudinal axles of adjacent rollers being such that the rollers are maintained in sequential contact;

b. first sealing means provided between the lateral faces of the first and last bearing members and edges of the gap adjacent thereto, said first sealing means comprising two cylindrical auxiliary rollers of rigid material mounted axially parallel to the bearing members, one of said auxiliary rollers being maintained in urgent contact with the lateral face of each of the first and last bearing members, and two pressure loaded bearing blocks, one bearing upon the lateral face of each of the auxiliary rollers and mounted in housings integral with the wall surrounding the gap, characterized in that the material comprising the bearing blocks has a coefficient of expansion greater than that of the material comprising the housings, and means for heating the bearing blocks;

c. second sealing means provided between the end faces of the auxiliary rollers and bearing members and edges of the gap adjacent thereto.

7. Apparatus as recited in claim 6 wherein said material comprising the bearing blocks is selected from the group consisting of Ferobestos.

8. Apparatus as recited in claim 6 wherein said material comprising the bearing blocks is a thermoplastic material.

9. Apparatus as recited in claim 8 wherein said thermoplastic material is nylon.

10. Apparatus as recited in claim 6 wherein said material comprising the housings is steel.

* * * * *

UNITED STATES PATENT OFFICE

CERTIFICATE OF CORRECTION

Patent No. 4,054,331 Dated October 18, 1977

Inventor(s) Guillaume Ward Jamin

It is certified that error appears in the above-identified patent and that said Letters Patent are hereby corrected as shown below:

Claim 2, line 3 should read --group consisting of brass and bronze--.

Claim 7, line 3 should read --group consisting of brass and bronze--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*